US006183521B1

(12) United States Patent
Lin et al.

(10) Patent No.: US 6,183,521 B1
(45) **Date of Patent: *Feb. 6, 2001**

(54) METHOD OF FIBER SCOURING WITH SUPERCRITICAL CARBON DIOXIDE

(75) Inventors: Wen-Fa Lin; Chi-Ying Hung; Jing-Wen Tang; Tien-Szu Hsieh, all of Hsinchu (TW)

(73) Assignee: Industrial Technology Research Institute, Hsin-Chu Hsein (TW)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/205,223

(22) Filed: Dec. 4, 1998

(30) Foreign Application Priority Data

Mar. 16, 1998 (TW) ..... 87103858

(51) Int. Cl.[7] ..... D06L 1/00
(52) U.S. Cl. ..... 8/139; 8/138; 8/142
(58) Field of Search ..... 8/138, 139, 142

(56) References Cited

U.S. PATENT DOCUMENTS 5,074,958 12/1991 Blaney .
5,233,021 8/1993 Sikorski .
5,267,455 * 12/1993 Dewees et al. ..... 68/5 C
5,279,615 * 1/1994 Mitchell et al. ..... 8/142
5,370,742 * 12/1994 Mitchell et al. ..... 134/10
5,412,958 * 5/1995 Lliff et al. ..... 68/5 C
5,431,843 * 7/1995 Mitchell et al. ..... 252/186.38
5,486,212 * 1/1996 Mitchell et al. ..... 8/142
5,512,058 * 4/1996 Gavend et al. ..... 8/94.18
5,526,834 * 6/1996 Mielnik et al. ..... 134/105
5,676,705 * 10/1997 Jureller et al. ..... 510/286
5,683,473 * 11/1997 Jureller et al. ..... 8/142
5,683,977 * 11/1997 Jureller et al. ..... 8/111
5,759,209 * 6/1998 Adler et al. ..... 8/142
5,792,218 * 8/1998 Alvarez et al. ..... 8/142
5,858,022 * 1/1999 Romack et al. ..... 8/142
5,858,107 * 1/1999 Chao et al. ..... 134/1
5,954,841 * 9/1999 Beven ..... 8/139
6,007,584 * 12/1999 Suzuki et al. ..... 8/139

* cited by examiner

*Primary Examiner*—Yogendra Gupta
*Assistant Examiner*—Christine E. Ingersoll
(74) *Attorney, Agent, or Firm*—Sughrue, Mion, Zinn, Macpeak & Seas, PLLC

(57) ABSTRACT

A method of removing spinning and finishing oils from fibers using supercritical carbon dioxide as an extraction media is provided. This process using carbon dioxide to remove oils from fiber surface operates at moderate pressures between 90 and 350 bar and at temperature levels ranghng from 40 to 120° C. The treated fibers have improved strength and elongation properties compared to those treated by conventional scouring. The treated fibers can be directly subjected to the subsequent dyeing processing.

9 Claims, 2 Drawing Sheets

METHOD OF FIBER SCOURING WITH SUPERCRITICAL CARBON DIOXIDE

BACKGROUND OF THE INVENTION

1. Field of the Invention

The present invention relates in general to a method of fiber scouring. More particularly, it relates to a method for removing oil agents from fibers using supercritical carbon dioxide as an extraction media.

2. Description of the Related Arts

As known in the art, spinning oils and finishing oils are respectively applied to the surface of artificial fibers when they are subjected to spinning and false twisting. The most commonly used spinning oils are ethylene oxide/propylene oxide (EO/pO) copolymer ester, while finishing oils are commonly coning oils. The spinning and finishing oils must be scoured from the fibers before they are subjected to subsequent processing, i.e., dyeing.

Referring to FIG. 1, the conventional scouring for artificial fibers includes three successive steps. The artificial fibers with oils agents are scoured with strong bases and scouring agents, neutralized with weak acids, and finally, rinsed by hot water. The major drawback of such method is that it necessitates a large quantity of rinsing agents including water, scouring agents, strong bases, and weak acids, thus making the practice of this method costly. Moreover, a substantial quantity of wastewater will be produced from the rising agents, whose treatment also raises the costs. Another drawback of the conventional scouring is its low efficiency. In general, it takes about 45 minutes to complete the scouring process.

SUMMARY OF THE INVENTION

It is therefore an object of the invention to provide a method of scouring fibers which reduces costs and improves efficiency, and does not produce wastewater.

To attain the above object, the present invention provides a method for scouring fibers by flowing carbon dioxide through the fibers under pressure and temperature conditions such that the carbon dioxide is a supercritical fluid and removes a substantial portion of the oil content from the fibers, which can be either natural fibers or artificial fibers such as polyester or nylon fibers.

The method using carbon dioxide to remove oils from fibers operates at moderate pressures between 90 and 350 bar and at temperature levels ranging from 40 to 120° C. The extraction efficiency can be modulated by varying the operating pressures and temperatures.

The present method is superior to the conventional method in several ways. The most important advantage of this method is its low cost. Referring to FIG. 2, this method significantly reduces the production cost by obviating the need for using large quantities of rinsing agents. Accordingly, the need for treating wastewater is also eliminated. It is also financially advantageous that the carbon dioxide can be recycled and the oil extract can be recovered. Another advantage of this method is its high efficiency. The scouring time of the present method is about ten minutes, whereas that of conventional scouring is about 45 minutes. A further advantage of this method is that the extraction efficiency can be simply controlled by regulating the operating pressures and temperatures. In addition, by using the supercritical carbon dioxide, the integration of the scouring process into the supercritical carbon dioxide dyeing process is made possible.

Other objects, features, and advantages of the present invention will become apparent from the following detailed description which makes reference to the accompanying drawings.

DESCRIPTION OF THE PREFERRED EMBODIMENTS

Figure 1:
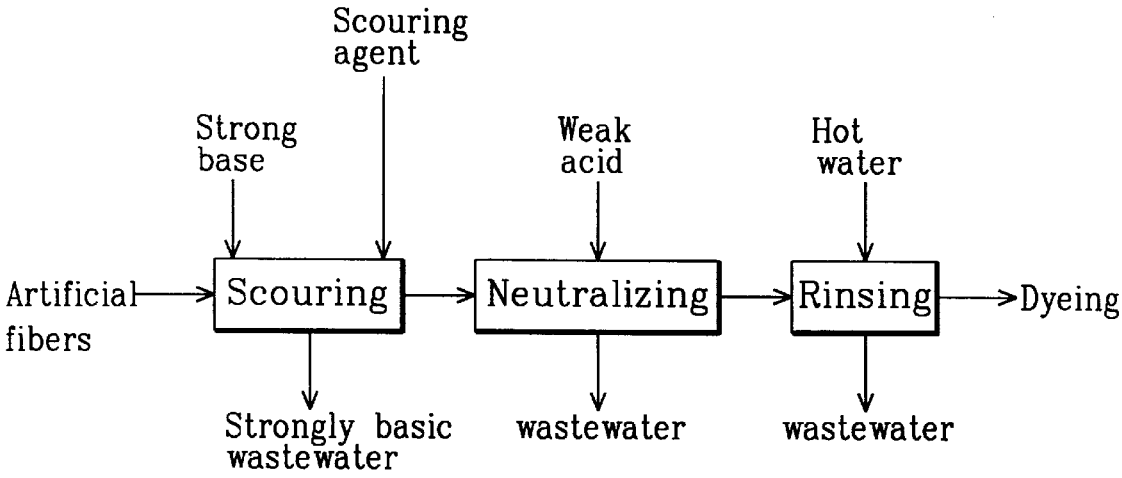
FIG. 1 (PRIOR ART)
FIG. 1 is a flow chart showing the process steps of the conventional scouring method.
Figure 2:
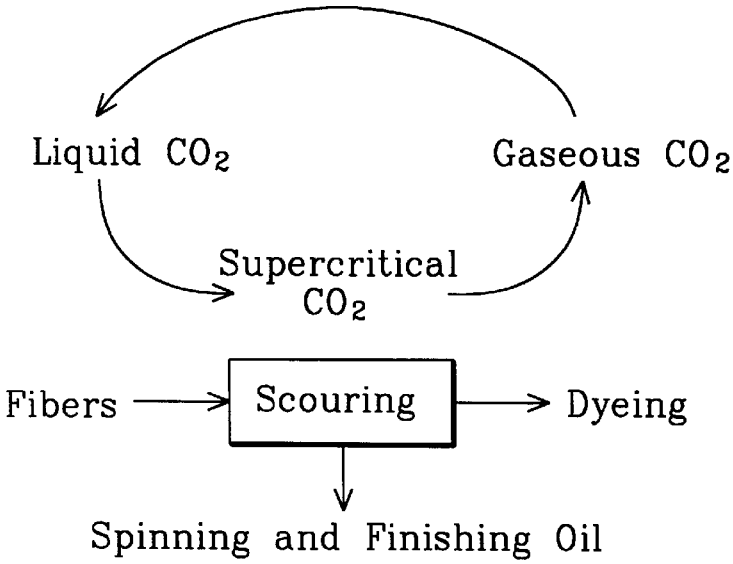
FIG. 2 is a flow chart showing the scouring method of the invention by using supercritical carbon dioxide.
Figure 3:
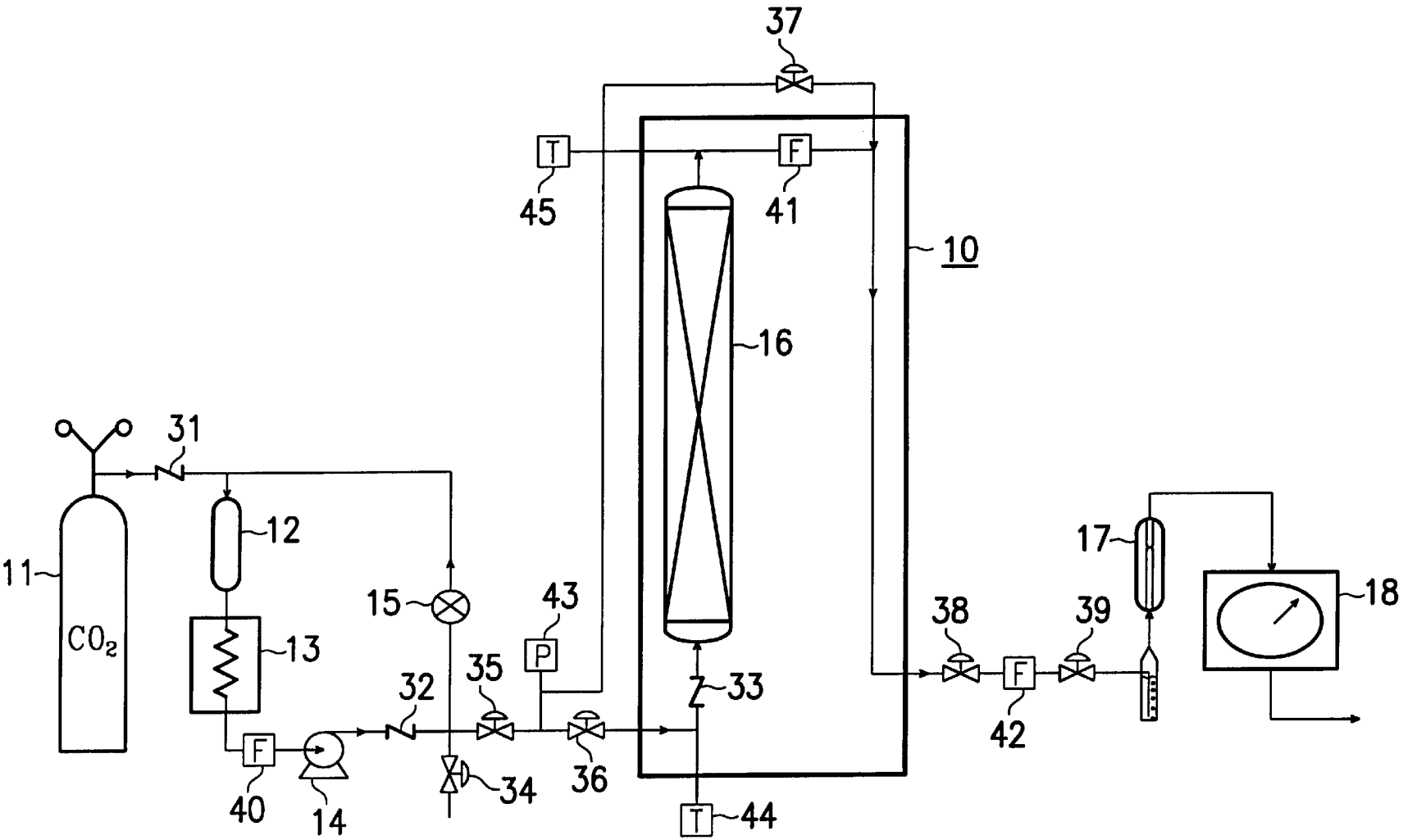
FIG. 3 illustrates representative equipment which can be used in the practice of the invention.

FIG. 3 shows representative apparatus for practicing the invention, in which 31–39 are valves (31–33 are check valves), 40–42 are filters, 43 is a pressure gauge, and 44–45 are thermal couples. It should be noted that apparatus other than that shown in FIG. 3 can be used to practice the invention. In the system of FIG. 3, liquid carbon dioxide from cylinder 11 is fed through water absorber 12 to cooling coil 13 which decreases the temperature of the liquid carbon dioxide. Water absorber 12 is a column filled up with molecular sieves which absorbs moisture in the liquid carbon dioxide. The cooled carbon dioxide is then passed through pump 14 which raises the pressure of the carbon dioxide. The pressure is maintained at a setting value by back pressure regulator 15; when the system pressure is greater than the setting value, the carbon dioxide is drawn back through back pressure regulator 15 to water absorber 12. The carbon dioxide is then passed through oven 10 where it is heated above its critical temperature. The supercritical carbon dioxide then enters extraction vessel 16 which has been previously loaded with fibers which are to be scoured. Extraction vessel 16 is made of stainless steel and has a capacity of about 22 ml. As shown in the FIG., vessel 16 is enclosed in oven 10 to maintain the temperature of the carbon dioxide above its critical temperature.

As the supercritical carbon dioxide passes through vessel 16 it extracts oil agents from the fibers. The supercritical carbon dioxide with its load of oils leaves vessel 16 and passes through pressure reduction valves 38, 39, which reduce the pressure of the carbon dioxide. As a result, the oil agents precipitate out of the carbon dioxide and are captured by a solvent of ethanol/n-hexane. After the oil agents have been removed, the carbon dioxide passes through flow meter 17 and wet gas meter 18. Wet gas meter 18 is used to measure accumulative gas flow and flow meter 17 is used to measure the flow rate of carbon dioxide through the system. According to the invention, the overall solvent-to-feed ratio is preferably between 0.5 to 10 grams $CO_2$ per gram of fiber.

Without intending to limit it in any manner, the present invention will be further illustrated by the following examples.

EXAMPLE 1

Polyester fibers with an oil content of 1.2–2.5% by weight were scoured at varying pressures and temperatures using the apparatus shown in FIG. 3. The oil agents consisted essentially of coning oils and EO/PO copolymers. Carbon dioxide was passed through the system at the rate of approximately 150 ml/min. The overall solvent-to-feed ratio was about 8.85 grams $CO_2$ per gram of fiber. The operating pressures were varied in a range from 96 to 345 bar and the operating temperatures were varied in a range from 40 to 120° C. The results of the experiment are shown in Table 1.

TABLE 1

| Extraction Efficiencies of SC—$CO_2$ in Removing Oil Agents from Polyester Fibers | | | | | | |
|---|---|---|---|---|---|---|
| Pressure Tempe. | 96.5 bar | 137.9 bar | 241.4 bar | 275.9 bar | 310.3 bar | 344.8 bar |
| 120° C. | 39% | — | 88% | 88% | 92% | 96% |
| 100° C. | — | — | 88% | 92% | 97% | — |
| 80° C. | — | — | 91% | 94% | 98% | — |
| 60° C. | — | 83% | 96% | 95% | 99% | — |
| 40° C. | 86% | — | 99% | 99% | 100% | 100% |

As shown in the above Table, extraction efficiencies ranging from 39 to 100% were attained by employing different pressures and temperatures. It can be seen that for a given temperature, the extraction efficiency increases with the operating pressure. On the contrary, for a given pressure, the extraction efficiency decreases with the operating temperature.

EXAMPLE 2

Nylon fibers were scoured by supercritical carbon dioxide at a pressure and temperature of 276 bar and 60° C. using the apparatus shown in FIG. 3. The overall solvent-to-feed ratio was 5.30 grams $CO_2$ per gram of fiber. The results of the experiment are shown in Table 2. As shown therein, a high level of extraction were achieved by using supercritical carbon dioxide scouring.

TABLE 2

| Extraction Efficiencies of SC—$CO_2$ in Removing Oil Agents from Nylon Fibers | | | |
|---|---|---|---|
| | | Oil Pick Up Rate (OPU) | Extraction Efficiency |
| Nylon 66 | Before scouring | 2.13% | — |
| | After scouring | 0.14% | 93% |
| Nylon 6 | Before scouring | 1.18% | — |
| | After scouring | 0.13% | 89% |

EXAMPLE 3

In this example, supercritical carbon dioxide scouring and conventional scouring were employed on polyester fibers individually to compare their effects on fibers' physical properties. In the conventional scouring, the polyester fibers were first scoured by a strong-base solution at 100° C. for 25 minutes, which was an aqueous solution containing 2 g of scouring agent and 3 g of sodium hydroxide per liter of water. The fibers were then neutralized with a weak-base solution at 50° C. for 10 minutes, which contained 0.5 g of acetic acid per liter of water. Finally, hot water of 85° C. was used to rinse the neutralized fibers for 10 minutes. The operating conditions of the supercritical carbon dioxide scouring are listed in Table 3. The scoured fibers were tested for their tensile properties and the results are also summarized in Table 3.

TABLE 3

| Physical Effects on Fibers After Scouring | | | | | | |
|---|---|---|---|---|---|---|
| Operating conditions of SC—$CO_2$ Scouring | | | Tensile property | | | |
| Temp. (° C.) | Pressure (bar) | $m_{co_2}$ | Tensile strength (gm/denier) | C.V. (%) | Elongation (%) | C.V. (%) |
| 120 | 345 | 8.85 | 4.52 | 4.05 | 37.41 | 5.6 |
| 40 | 241 | 8.85 | 4.34 | 5.59 | 41.15 | 9.06 |
| Polyester fibers (before scouring) | | | 4.59 | 2.67 | 25.52 | 7.94 |
| Polyester fibers (conventional scouring) | | | 4.19 | 8.60 | 30.21 | 19.0 |

$m_{co_2}$: the ratio of grams of $CO_2$ used per gram of fibers
C.V.: coefficient of variation The above Table indicates that the conventional scouring adversely affected the fibers on both the tensile strength and the elongation. On the contrary, the supercritical carbon dioxide scouring had little effects on the tensile strength and coefficient of variation; moreover, it actually improved the elongation.

EXAMPLE 4

In this example, the supercritical carbon dioxide was performed at a fixed pressure and temperature of 310 bar and 80° C., and the amount of carbon dioxide used was varied in a stepwise manner to regulate the extraction efficiency. The scouring was carried out for a period of ten minutes and the results are shown in Table 4. As shown therein, a 90% extraction was attained in ten minutes by using less than 2 grams of carbon dioxide per gram of fibers. Furthermore, since the extraction efficiency increases with the amount of carbon dioxide, a complete removal was accomplished by using a greater amount of carbon dioxide.

TABLE 4

| $m_{co_2}$ | Extraction efficiency |
|---|---|
| 0.29 | 86% |
| 0.59 | 87% |
| 1.77 | 90% |
| 3.54 | 95% |
| 5.31 | 97% |
| 7.08 | 95% |
| 8.85 | 100% |
| 10.62 | 100% |

$m_{co_2}$: the ratio of grams of $CO_2$ used per gram of fibers

In summary, the supercritical carbon dioxide scouring of the invention has the following advantages:

1. Carbon dioxide is non-toxic and easy to handle.
2. Aqueous rinsing agents are not necessary, thus avoiding the need for wastewater treatment and reducing the production costs.
3. A higher throughput can be obtained since the scouring time is shortened from 45 to 10 minutes on the average.
4. The carbon dioxide can be recycled for use, and the recovery of the oils agents is possible.
5. The integration of the scouring process into the supercritical carbon dioxide dyeing process is made possible.

While the invention has been particularly shown and described with the reference to the preferred embodiment thereof, it will be understood by those skilled in the art that various changes in form and details may be made without departing from the spirit and scope of the invention.

What is claimed is:

1. An improved method of scouring fibers having an oil content of about 1.2 to 2.5% by weight of the fibers, which comprises:

flowing carbon dioxide through the fibers under pressure and temperature conditions such that the carbon dioxide is a supercritical fluid, thereby removing a substantial portion of the oil content from the fibers, wherein said fibers, upon being scoured, have retained tensile strength and improved elongation.

2. The method as claimed in claim 1, wherein the pressure is between 90 and 350 bar.

3. The method as claimed in claim 2, wherein the temperature is between 40 and 120° C.

4. The method as claimed in claim 1, wherein the ratio of grams of supercritical carbon dioxide to the grams of fibers is between 0.5 to 10.

5. The method as claimed in claim 4, wherein the oil content of the fibers is reduced by 39 to 100%.

6. The method as claimed in claim 1, wherein the fibers are natural fibers.

7. The method as claimed in claim 1, wherein the fibers are artificial fibers.

8. The method as claimed in claim 7, wherein the fibers are polyester or nylon fibers.

9. The method as claimed in claim 8, wherein the oil content consists essentially of ethylene oxide/propylene oxide copolymer ester and coning oil.

* * * * *